US006476687B1

(12) United States Patent
Miyamoto et al.

(10) Patent No.: US 6,476,687 B1
(45) Date of Patent: Nov. 5, 2002

(54) DIELECTRIC FILTER PROVIDING TEM- AND TE-MODE RESONATORS AND COMMUNICATON DEVICE USING THE SAME

(75) Inventors: Hirofumi Miyamoto, Kanazawa; Kikuo Tsunoda, Osaka-fu, both of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/569,787

(22) Filed: May 12, 2000

(30) Foreign Application Priority Data

May 13, 1999 (JP) ..... 11-132771

(51) Int. Cl.[7] ..... H01P 1/213; H01P 1/205
(52) U.S. Cl. ..... 333/134; 333/202; 333/206
(58) Field of Search ..... 333/206, 202, 333/202 DB, 134

(56) References Cited

U.S. PATENT DOCUMENTS 4,673,902 A * 6/1987 Takeda et al. ..... 333/206 X
5,859,375 A * 1/1999 Hino ..... 333/206

FOREIGN PATENT DOCUMENTS

JP 9-223904 8/1997

OTHER PUBLICATIONS

Japanese Examination Report dated May 29, 2002, along with an English translation.

* cited by examiner

*Primary Examiner*—Benny T. Lee
(74) *Attorney, Agent, or Firm*—Ostrolenk, Faber, Gerb & Soffen, LLP

(57) ABSTRACT

A dielectric filter includes a dielectric block and an outer conductor on outer surfaces of the dielectric block. The dielectric block has holes having inner conductors, with gaps provided by sections devoid of inner conductor. A section devoid of outer conductor is formed on an edge portion around a stray surface of the dielectric block. Accordingly, a TE-mode resonance having one quarter the wavelength in the axial length direction of the dielectric block is generated. The TE-mode resonance and a TEM-mode resonance are combined to form an attenuation pole.

12 Claims, 7 Drawing Sheets

FIG. 2D
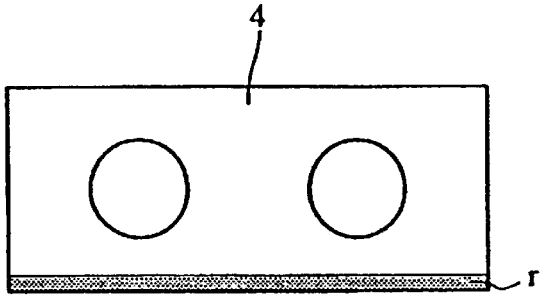
FIG. 2A
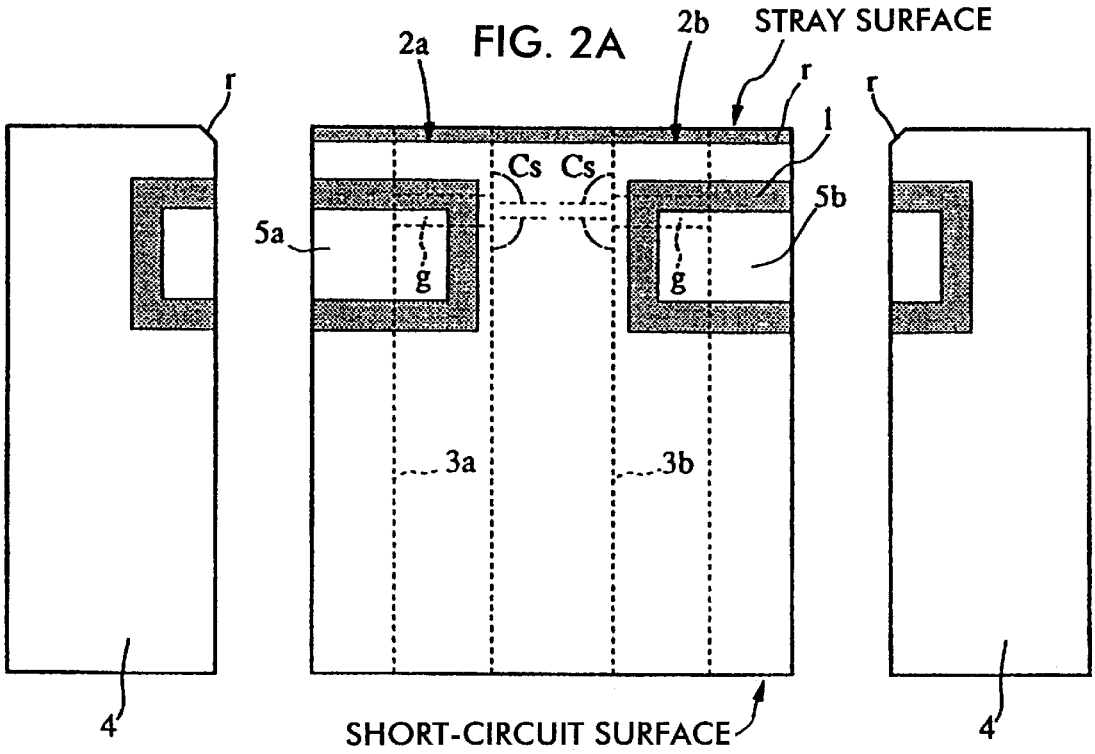
FIG. 2B
FIG. 2C
FIG. 2E
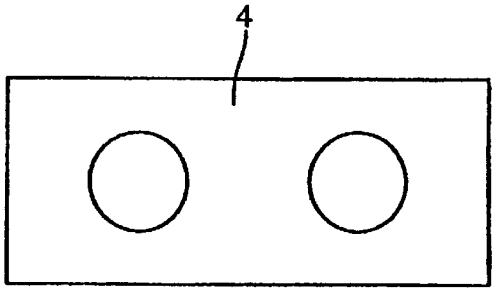

DIELECTRIC FILTER PROVIDING TEM- AND TE-MODE RESONATORS AND COMMUNICATON DEVICE USING THE SAME

BACKGROUND OF THE INVENTION

1. Field of the Invention

The present invention relates to dielectric filters primarily for use in the microwave band and to communication apparatuses using the same.

2. Description of the Related Art

A conventional dielectric filter having a conductor film on a dielectric block is constructed by forming a substantially rectangular dielectric block, which has a plurality of holes therein, and by forming an outer conductor on outer surfaces of the dielectric block. Inner conductors are formed in the holes while certain portions of the holes near apertures of the holes are devoid of inner conductor, forming respective gaps in the inner conductors.

With this arrangement, the dielectric block, the inner conductors, and the outer conductor operate as resonators in a transverse electromagnetic (TEM) mode. The resonators are combline-coupled by stray capacitance formed in the sections devoid of inner conductor. In the dielectric filter having the above arrangement, an attenuation pole (which will be referred to as a coupling pole) is generated by the coupling between the resonators. The attenuation pole is employed to provide a steep attenuation curve between a pass band and a lower stop band, or between the pass band and a higher stop band.

Since the resonators are combline-coupled by the stray capacitance generated in the sections devoid of inner conductor, the attenuation pole is generated. When the attenuation pole is generated in the lower stop band near the pass band, the attenuation characteristics become steeper in the band below the pass band. In contrast, the attenuation characteristics between the pass band and the higher stop band are not improved or controlled. If steep attenuation characteristics are required between the pass band and both the lower and higher stop bands, it is necessary to increase the number of poles generated by the resonators, or to employ additional structures to create another attenuation pole. As a result, the overall structure of the dielectric filter becomes complex and is difficult to miniaturize.

In the above dielectric filter having the outer conductor on the outer surfaces of the substantially rectangular dielectric block, resonant modes, such as a $TE_{101}$ mode, in addition to the TEM mode, which is the fundamental mode, are generated by the dielectric block and the outer conductor.

The resonant modes other than the fundamental TEM mode which is intended for actual use are regarded as spurious modes, and efforts have been made to suppress these spurious modes. For example, Japanese Unexamined Patent Application Publication No. 8-51301 proposes to partially trim the outer conductor on the end surface of the dielectric block near the sections devoid of inner conductor, thus adjusting the TE-mode resonant frequency. Specifically, the TE-mode resonant frequency is separated from the TEM-mode resonant frequency so as to suppress the influence of the TE mode.

SUMMARY OF THE INVENTION

Accordingly, it is an object of the present invention to provide a dielectric filter, having a simplified overall structure, for eliminating or minimizing the above problems by generating an attenuation pole other than the above-described coupling pole, and a communication apparatus using the same.

According to one aspect of the present invention, there is provided a dielectric filter including a substantially rectangular dielectric block which has a plurality of holes therein; an outer conductor on outer surfaces of the dielectric block; and inner conductors in the holes, the inner conductors having gaps which are devoid of inner conductor near apertures of the holes. The dielectric block, the inner conductors, and the outer conductor form a plurality of TEM-mode resonators. The TEM-mode resonators are coupled to each other so as to generate an attenuation pole in a band below a pass band. A section devoid of outer conductor is provided on part of an edge portion around an opening surface of the dielectric block in which the holes open.

Since the outer conductor is formed on the outer surfaces of the dielectric block, the, entire dielectric block and the outer conductor operate as a TE-mode resonator. The section devoid of outer conductor is provided to generate the TE mode having a low resonant frequency. The TE-mode resonance and the TEM-mode resonance are combined to generate an attenuation pole in a band higher than and close to the pass band.

The opening surface may be a surface nearer to the gaps. Thus, even when the section devoid of outer conductor is formed on the edge portion around the opening surface, the TEM mode maintains the greatest electrical field strength at the gaps, so that the characteristics of the TEM-mode resonators are not significantly influenced. As a result, the TE-mode resonant frequency can be brought closer to the TEM-mode resonant frequency in a more efficient manner. Since the section devoid of outer conductor is not formed on a short-circuit surface having a high current density, the quality factor (Q) of the resonators will not be reduced.

The section devoid of outer conductor may be provided on the edge portion along at least a long side of the opening surface of the dielectric block. Thus, the TE mode having a low resonant frequency can be easily generated even when the section devoid of outer conductor is relatively small.

The section devoid of outer conductor may be formed by first forming a projection at an edge portion of the dielectric block, then forming the outer conductor on the dielectric block, and then removing the outer conductor from the projection. With this method, the section devoid of outer conductor is easily obtained by simply removing the projection, subsequent to forming the outer conductor on the outer surfaces of the dielectric block including the edge portion having the projection.

According to another aspect of the present invention, there is provided a communication apparatus including the above dielectric filter for use in a high frequency circuit for microwave band signals.

Other features and advantages of the present invention will become apparent from the following description of embodiments of the invention which refers to the accompanying drawings, in which like references denote like elements and parts, and unnecessary redundant duplicative descriptions are omitted.

BRIEF DESCRIPTION OF THE DRAWINGS

FIG. 2A is a plan view and FIGS. 2B, 2C, 2D and 2E are elevation views of respective sides of the dielectric filter;

DETAILED DESCRIPTION OF EMBODIMENTS OF THE INVENTION

A dielectric filter according to an embodiment of the present invention is described hereinafter with reference to the accompanying drawings.

Figure 1:
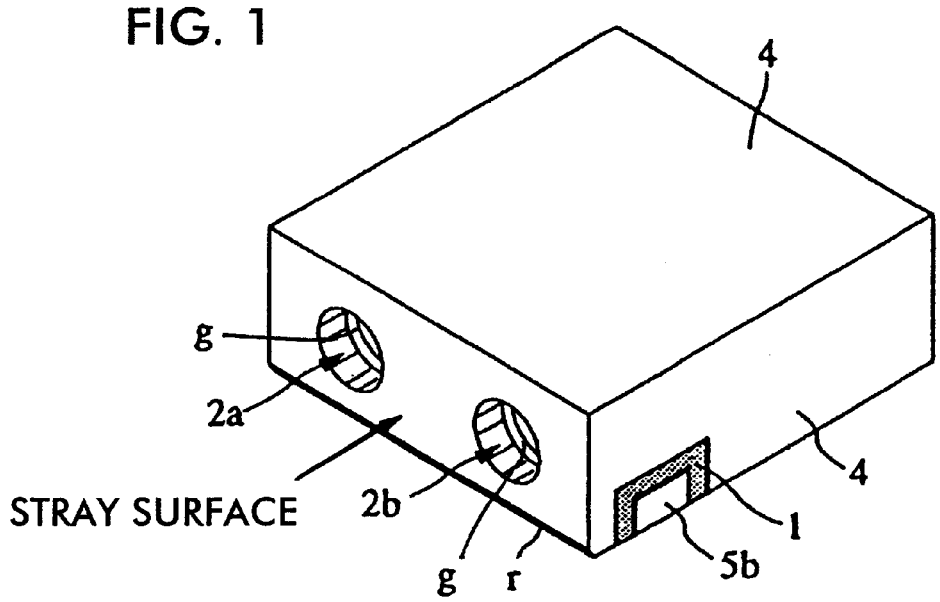
FIG. 1 is a perspective view of a dielectric filter according to an embodiment of the present invention.

FIG. 1 shows a perspective view of the dielectric filter. Referring to FIG. 1, a substantially rectangular dielectric block 1 includes an outer conductor 4 on outer surfaces (six surfaces) thereof. The dielectric block 1 includes two through holes 2*a* and 2*b* therein. Inner conductors 3*a* and 3*b* are formed in the through holes 2*a* and 2*b*, respectively, while predetermined portions in the through holes 2*a* and 2*b* are devoid of inner conductor, thereby forming gaps g (FIG. 2A). Hereinafter the through holes 2*a* and 2*b* are referred to as "holes having inner conductors". Two input/output electrodes 5*a* (not shown) and 5*b* are formed on the outer surfaces of the dielectric block 1 while being separated from the outer conductor 4. As shown in FIG. 1, a section devoid of outer conductor r is formed on one of four edges surrounding the end surface of the dielectric block nearest to the gaps g, hereinafter referred to as the "stray surface." The section devoid of outer conductor r is structured in this example by forming the outer conductor 4 beforehand and then grinding the corresponding edge section, thus partially removing the dielectric material and the outer conductor 4.

FIG. 2A shows a plan view and FIGS. 2B to 2E show side elevation views of the above dielectric filter. FIG. 2A is a view of a mounting surface of the dielectric filter which faces toward a circuit board. FIG. 2B is a left side view. FIG. 2C is a right side view. FIG. 2D is a front view. FIG. 2E is a rear view. The holes having inner conductors 2*a* and 2*b* have gaps g formed in the inner surfaces thereof. The inner conductors 3*a* and 3*b* are formed on portions other than the gaps g. Stray capacitance $C_s$ is generated in the gaps g. The dielectric block 1 has the stray surface, which is the end surface thereof nearest to the gaps g, and a short-circuit surface opposed to the stray surface, where the outer conductor 4 is connected to the inner conductors 3*a* and 3*b*. With this arrangement, the inner conductors 3*a* and 3*b*, the outer conductor 4, and the dielectric block 1 operate as two resonators in a TEM mode, which are combline-coupled by the stray capacitance $C_s$. In the TEM mode, the greatest electrical field strength is at the gaps g, and thereby the electric field at the section devoid of outer conductor r is substantially separated from that at the resonant portions of the dielectric filter at inner conductors 3*a* and 3*b*. Thus, the influence of the section devoid of outer conductor r on the resonance in the TEM mode is minimized.

Figure 3:
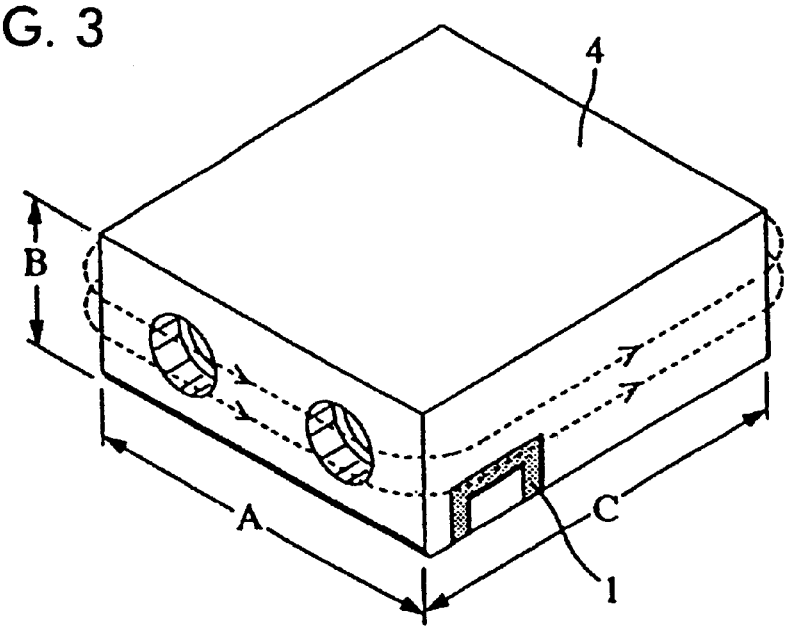
FIG. 3 is an illustration of the magnetic field distribution of a $TE_{101}$ mode generated in the dielectric filter.

FIG. 3 shows the magnetic field distribution of a $TE_{101}$ mode generated by the dielectric block 1 and the outer conductor 4. The resonant frequency in the TE mode is influenced not only by the length (in the axial direction of the holes) of the dielectric block 1 but also by the width of the dielectric block 1. A resonant frequency f in the $TE_{101}$ mode having a wavelength in the axial length direction of the dielectric block 1 which is half of a guide wavelength is expressed as follows (equation 1):

$$f = \frac{V_c}{2\sqrt{\epsilon r}\sqrt{\left(\frac{1}{A}\right)^2 + \left(\frac{0}{B}\right)^2 + \left(\frac{1}{C}\right)^2}}$$

where $V_c$ represents the velocity of light, $\epsilon_r$ represents the relative dielectric constant, A represents the width, B represents the thickness, and C represents the axial length.

Since the section devoid of outer conductor r is provided on a portion in which the resonance of the $TE_{101}$ mode having half the wavelength in the axial length direction of the dielectric block 1 is generated, the outer conductor 4 is opened at that portion. Additionally, a TE mode (i.e., $TE_{1,0,0.5}$ mode) having one quarter the wavelength in the axial length direction of the dielectric block 1 is generated. The resonant frequency f in this mode is expressed as follows (equation 2):

$$f = \frac{V_c}{2\sqrt{\epsilon r}\sqrt{\left(\frac{1}{A}\right)^2 + \left(\frac{0}{B}\right)^2 + \left(\frac{1}{2C}\right)^2}}$$

Figure 4A:
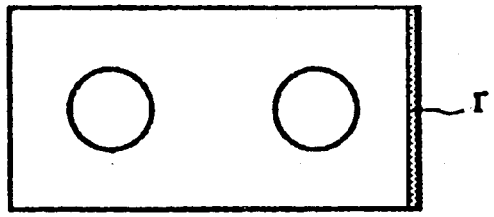
FIGS. 4A, 4B, 4C and 4D are illustrations of various positions at which a section devoid of outer conductor may be provided.
Figure 4B:
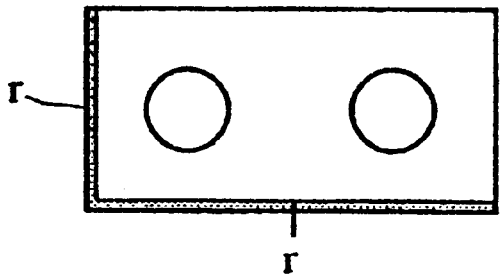
Figure 4C:
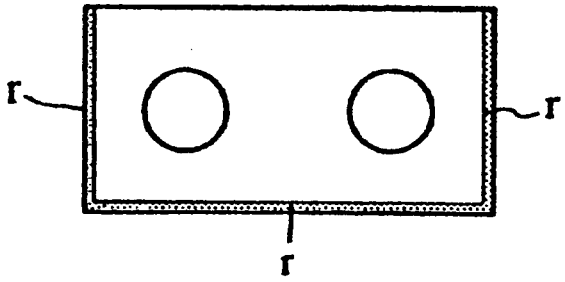
Figure 4D:
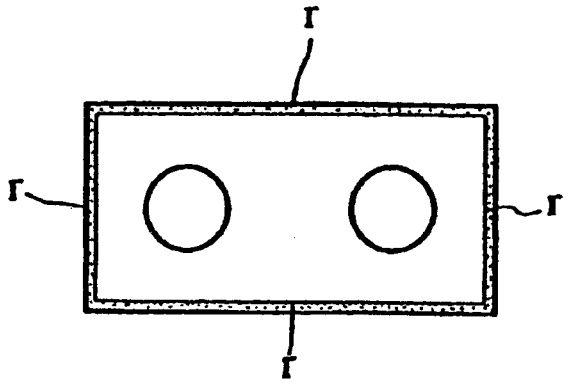

In the above example, the section devoid of outer conductor r is obtained by cutting one of the four edge lines formed around the stray surface. Alternatively, the section devoid of outer conductor r can be provided at another location or at a plurality of locations. FIGS. 4A to 4D illustrate locations at which the outer conductor r can be provided. Referring to FIG. 4A, the section devoid of outer conductor r can be formed on the edge portion (in the thickness direction) along the short side of an opening surface of the dielectric block 1. The opening surface in this example is the stray surface including the holes having inner conductors. Referring now to FIG. 4B, the section devoid of outer conductor r can be formed on two edges (in the width and the thickness directions) along the short and long sides of the opening surface of the dielectric block 1. As shown in FIG. 4C, the section devoid of outer conductor r can be provided on three edge lines. As shown in FIG. 4D, the section devoid of outer conductor r can be provided on four edge lines.

If the section devoid of outer conductor r can be provided on four edge lines, as shown in FIG. 4D, the outer conductor 4 on the stray surface is D.C.-separated from the outer conductor 4 on the other surfaces. In this case, the stray capacitance $C_s$ between the TEM-mode resonators is also generated between the open ends of the inner conductors 3*a* and 3*b* and the outer conductor 4 on the upper and lower surfaces of the dielectric block 1. In addition, electrostatic capacitance is generated between the outer conductor 4 on the stray surface and the outer conductor 4 on the other surfaces. Therefore, the two resonators in the TEM mode can be combline-coupled also in the case when the section devoid of outer conductor r is formed on four edge lines.

Figure 5A:
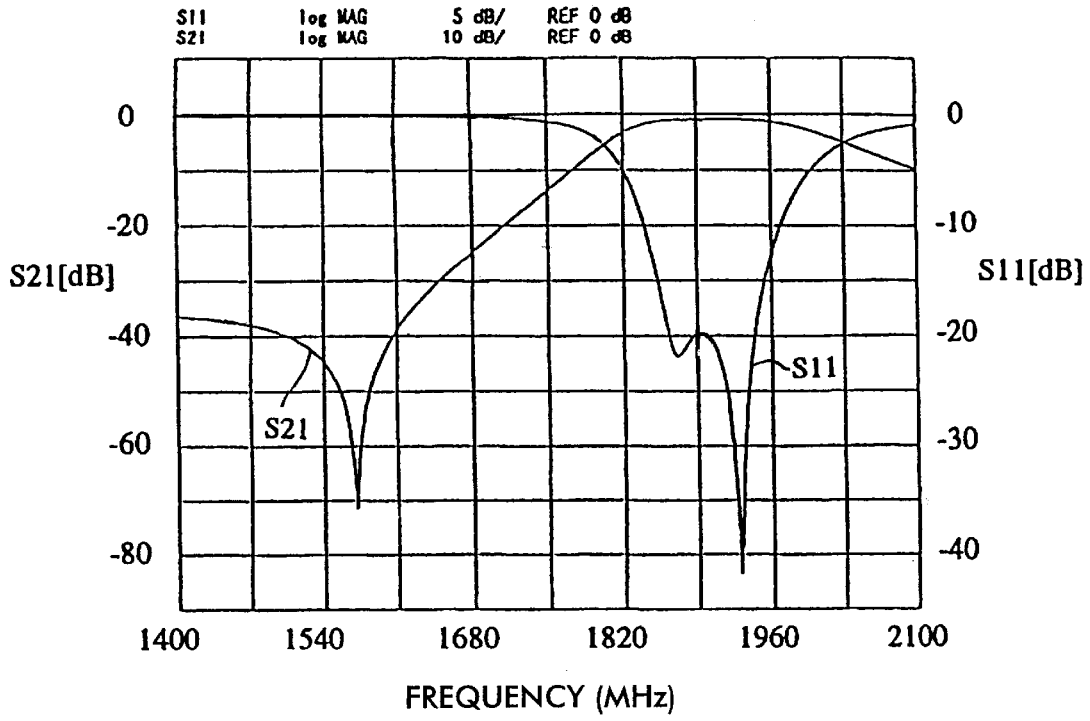
FIGS. 5A and 5B are graphs showing variations in characteristics caused by providing the section devoid of outer conductor in the TEM mode.
Figure 5B:
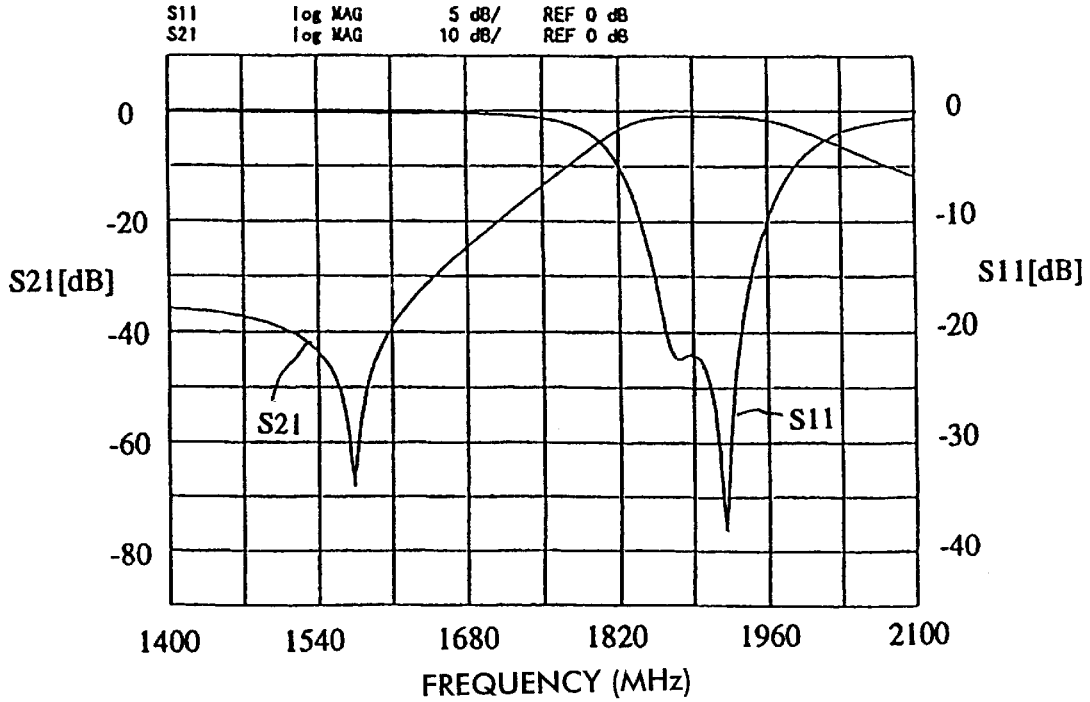

FIGS. 5A and 5B are graphs showing variations in S11 and S21 characteristics in the TEM mode caused by providing the section devoid of outer conductor r. This example shows band-pass characteristics having a center frequency of 1895.0 MHZ. In this example, an attenuation pole is generated in a lower band by the combline coupling. FIG. 5A shows characteristics prior to providing the section devoid of outer conductor r. FIG. 5B shows characteristics subsequent to providing the section devoid of outer conductor r. As shown in FIGS. 5A and 5B, the pass-band and stop-band characteristics are not significantly varied by providing the section devoid of outer conductor r.

Figure 6A:
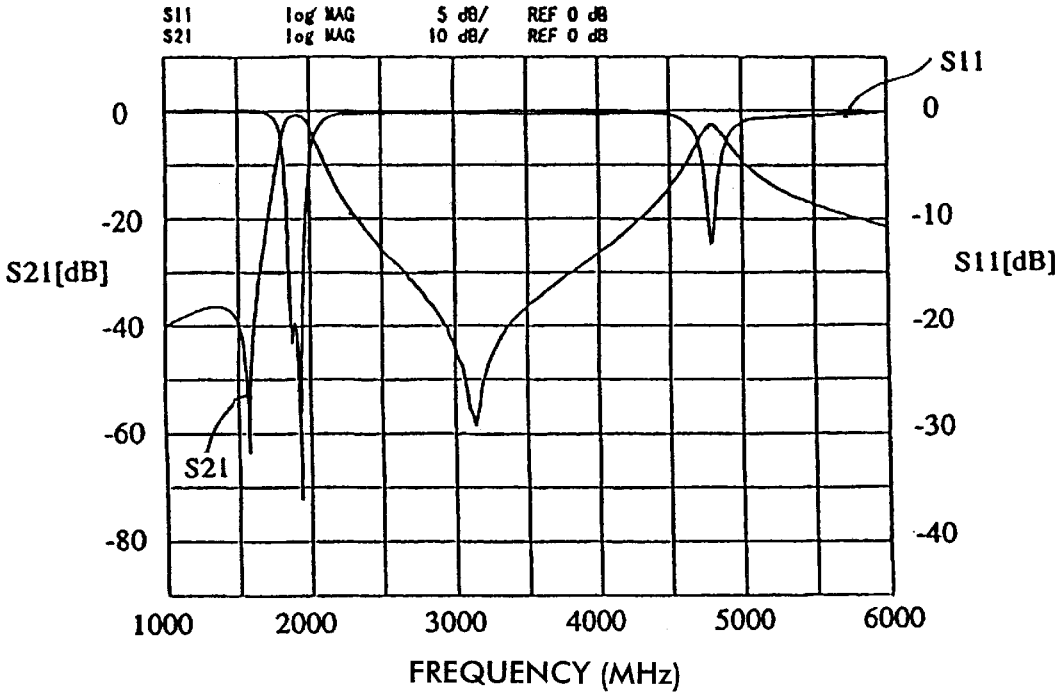
FIGS. 6A and 6B are graphs showing variations in characteristics caused by providing the section devoid of outer conductor of the dielectric resonators including a TE mode.
Figure 6B:
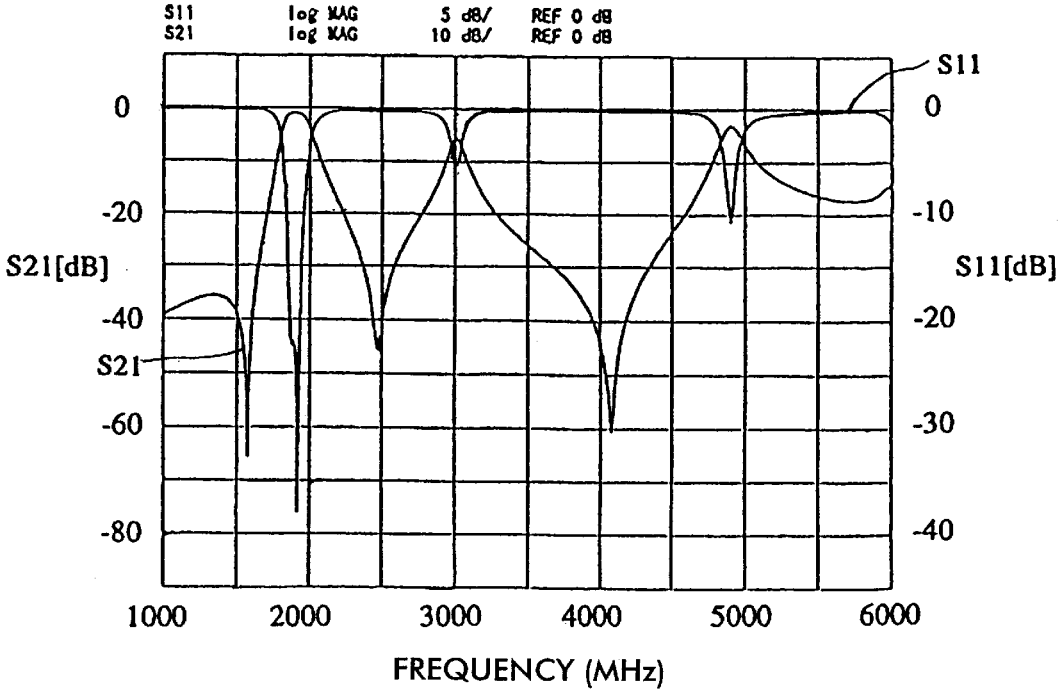

FIGS. 6A and 6B show the measurement results of the same example as in FIGS. 5A and 5B, in which the frequency range covered by the horizontal axis is expanded. FIG. 6A shows characteristics obtained prior to providing the section devoid of outer conductor r. As shown in FIG. 6A, the $TE_{101}$ mode resonates at 4795.0 MHZ as indicated by marker "3". Accordingly, the resonance of the $TE_{101}$ mode and the resonance of the TEM mode are combined to generate the attenuation pole at 3140.0 MHZ indicated by marker "2". Then, the section devoid of outer conductor r is provided. As shown in FIG. 6B, the $TE_{1,\ 0,\ 0.5}$ mode is additionally generated, which resonates at 3005.0 MHZ as indicated by marker "3".

Accordingly, the resonance of the $TE_{1,\ 0,\ 0.5}$ mode and the resonance of the TEM mode are combined to generate the attenuation pole at 2465.0 MHZ indicated by marker "2". As a result, the attenuation characteristics of the TEM resonators above the pass band become steeper.

Accordingly, the attenuation characteristics both above and below the pass band are improved.

Figure 7A:
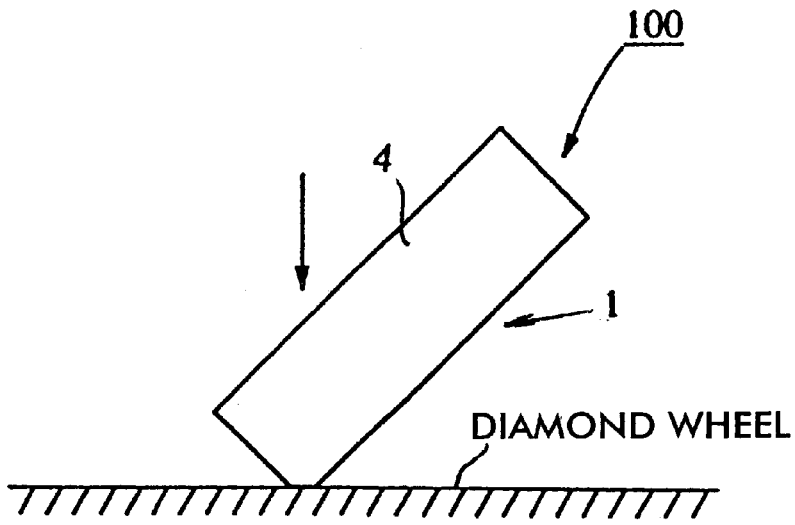
FIGS. 7A and 7B are illustrations of examples of a process of forming the section devoid of outer conductor.
Figure 7B:
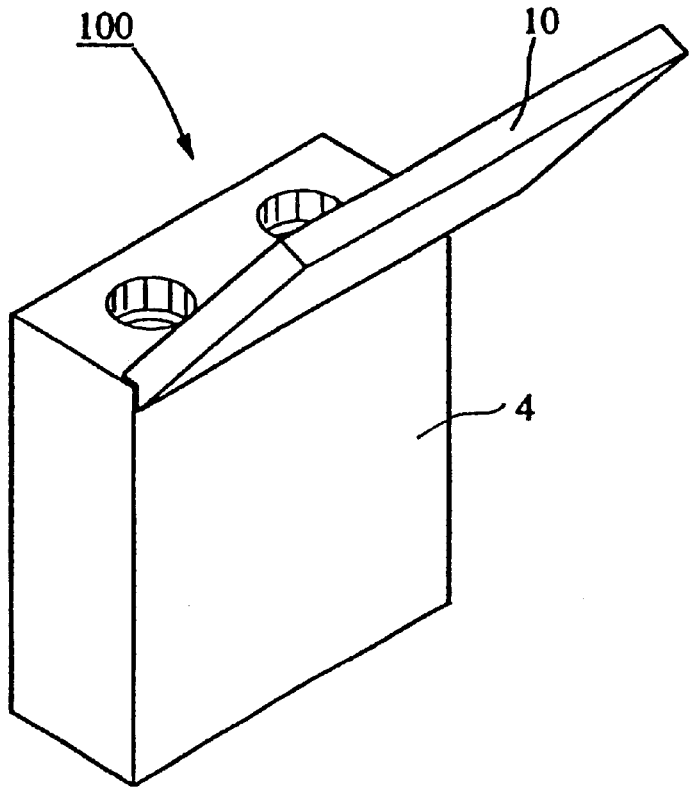
Figure 8A:
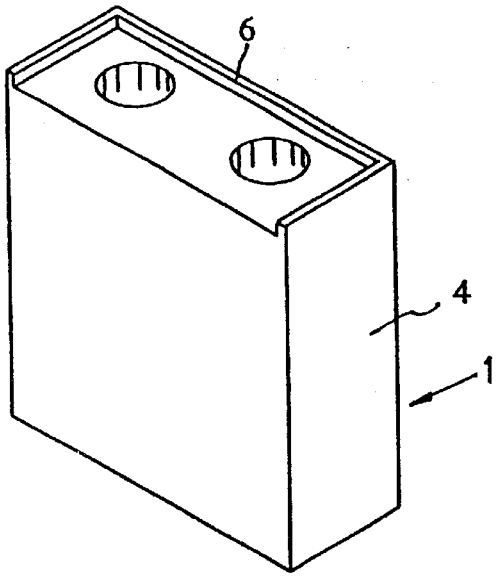
FIGS. 8A and 8B are illustrations of examples of the process of forming the section devoid of outer conductor.
Figure 8B:
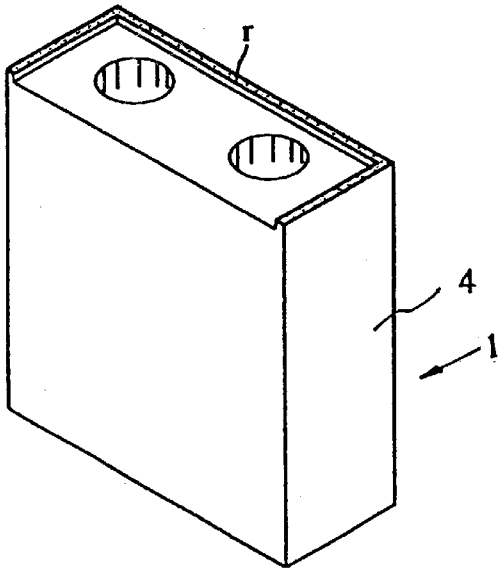

Referring now to FIGS. 7A and 7B and to FIGS. 8A and 8B, processes for forming the section devoid of outer conductor r are described.

FIG. 7A shows a dry grinding method. A predetermined edge portion of a dielectric filter 100 is pressed against a diamond wheel at a predetermined pressure, thus grinding the dielectric material and the outer conductor 4 of the dielectric block 1. With this method, the section devoid of outer conductor r is easily provided.

FIG. 7B shows a wet grinding method. A knife point of an ultrasonic grinding tool 10 is pressed against a predetermined edge portion of the dielectric filter 100, thus partially removing the outer conductor 4 and the dielectric material at the edge portion. With this method, the section devoid of outer conductor (not visible in FIG. 7B) can be provided by partially grinding the outer conductor 4 as part of the same grinding process in which the input/output electrodes 5*a* and 5*b* are formed, as shown in FIG. 2A. Thus, this method does not need to incorporate a special process to provide the section devoid of outer conductor.

Alternatively, other wet grinding methods, such as wet blasting, can be employed to form the section devoid of outer conductor.

FIGS. 8A and 8B show another method of providing the section devoid of outer conductor r. As shown in FIG. 8A, when the dielectric block 1 is formed, a projection 6 is provided projecting from the edge portion where the section devoid of outer conductor r is to be provided. As shown in FIG. 8A, the outer conductor 4 has been formed on the entire outer surface of the dielectric block 1. Subsequently, as shown in FIG. 8B, the entire surface of the projection 6 is ground by a predetermined amount. Thus, the outer conductor 4 formed on the end surface of the projection 6 is removed, thereby forming the section devoid of outer conductor r. With this method, the section devoid of outer conductor r can be simultaneously provided at a plurality of edge portions, thus increasing the productivity.

Figure 9:
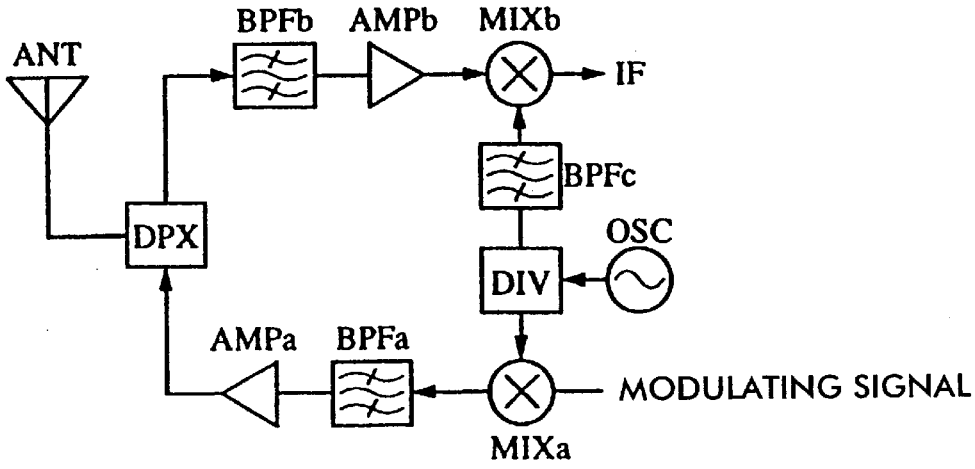
FIG. 9 is a block diagram of a communication apparatus according to an embodiment of the present invention.

Referring to FIG. 9, a communication apparatus using the above dielectric filter is described. The communication apparatus includes a transmitting/receiving antenna ANT, a duplexer DPX, band pass filters BPFa, BPFb, and BPFc, amplifying circuits AMPa and AMPb, mixers MIXa and MIXb, an oscillator OSC, and a frequency divider DIV. The mixer MIXa modulates a frequency signal output from the divider DIV using a modulating signal. The bandpass filter BPFa exclusively passes the signal in the transmission frequency band. The amplifier AMPa performs power amplification of the signal and transmits the signal from the antenna ANT through the duplexer DPX. The bandpass filter BPFb exclusively passes the signal output from the duplexer DPX in the reception frequency band, and the amplifier AMPb amplifies the signal. The mixer MIXb mixes the frequency signal output from the bandpass filter BPFc and a reception signal and outputs an intermediate frequency signal IF.

The dielectric filter having the above structure can be employed to construct the band pass filters BPFa, BPFb, and BPFc shown in FIG. 9. The overall size of the communication apparatus can be reduced by using the dielectric filter having excellent high frequency circuit characteristics.

Although the present invention has been described in relation to particular embodiments thereof, many other variations and modifications and other uses will become apparent to those skilled in the art. Therefore, the present invention is not limited by the specific disclosure herein.

What is claimed is:

1. A communication apparatus comprising:

a high-frequency circuit comprising at least one of a transmitting circuit and a receiving circuit;

said at least one of a transmitting circuit and a receiving circuit comprising a respective dielectric filter, said respective dielectric filter comprising:

a substantially rectangular dielectric block having a plurality of holes therein, wherein the plurality of holes have respective openings in a pair of opposed opening surfaces of the dielectric block;

an outer conductor disposed on an outer surface of the dielectric block; and inner conductors disposed in the plurality of holes, respective gaps devoid of inner conductor being disposed near apertures of the corresponding holes and being defined by respective sections of the holes;

wherein the dielectric block, the inner conductors and the outer conductor define a plurality of coupled TEM-made resonators, thus generating a first attenuation pole at a frequency below and close to a pass band of said filter;

wherein the dielectric block and the outer conductor define a TE-mode resonator; and wherein a section devoid of outer conductor is located on at least part of an edge of one of said opening surfaces of the dielectric block, thereby setting a resonant frequency of said TE-mode resonator defined by the dielectric block and the outer conductor, such that a second attenuation pole is generated at a frequency above and close to the pass band by coaction of the TEM-mode and TE-mode resonator characteristics; and wherein said first and second attenuation poles respectively define lower edge and a higher edge of said passband.

2. A dielectric filter comprising:

a substantially rectangular dielectric block having a plurality of holes therein, wherein the plurality of holes have respective openings in a pair of opposed opening surfaces of the dielectric block;

an outer conductor disposed on an outer surface of the dielectric block; and inner conductors disposed in the plurality of holes, respective gaps devoid of inner conductor being disposed near apertures of the corresponding holes;

wherein the dielectric block, the inner conductors and the outer conductor define a plurality of coupled TEM-mode resonators, thus generating a first attenuation pole at a frequency below and close to a pass band of said filter;

wherein the dielectric block and the outer conductor define a TE-mode resonator;

wherein a section devoid of outer conductor is located on at least part of an edge of one of said opening surfaces of the dielectric block, thereby setting a resonant frequency of said TE-mode resonator defined by the dielectric block and the outer conductor, such that a second attenuation pole is generated at a frequency above and close to the pass band by coaction of the TEM-mode and TE-mode resonator characteristics; and wherein said one of said opening surfaces is the opening surface nearest to the respective gaps devoid of inner conductor.

3. A dielectric filter according to claim 2, wherein the section devoid of outer conductor is disposed on the edge portion along at least a long side of the opening surface.

4. A dielectric filter according to claim 3, wherein the section devoid of outer conductor is disposed on a projection which projects from said edge portion of said dielectric body.

5. A dielectric filter according to claim 2, wherein the section devoid of outer conductor is disposed on a projection which projects from said edge portion of said dielectric body.

6. A dielectric filter comprising:

a substantially rectangular dielectric block having a plurality of holes therein, wherein the plurality of holes have respective openings in a pair of opposed opening surfaces of the dielectric block;

an outer conductor disposed on an outer surface of the dielectric block; and inner conductors disposed in the plurality of holes, respective gaps devoid of inner conductor being disposed near apertures of the corresponding holes;

wherein the dielectric block, the inner conductors and the outer conductor define a plurality of coupled TEM-mode resonators, thus generating a first attenuation pole at a frequency below and close to a pass band of said filter;

wherein the dielectric block and the outer conductor define a TE-mode resonator;

wherein a section devoid of outer conductor is located on at least part of an edge of one of said opening surfaces of the dielectric block, thereby setting a resonant frequency of said TE-mode resonator defined by the dielectric block and the outer conductor, such that a second attenuation pole is generated at a frequency above and close to the pass band by coaction of the TEM-mode and TE-mode resonator characteristics; and wherein the section devoid of outer conductor is disposed on a projection which projects from said edge portion of said dielectric body.

7. A dielectric filter comprising:

a substantially rectangular dielectric block having a plurality of holes therein, wherein the plurality of holes have respective openings in a pair of opposed opening surfaces of the dielectric block;

an outer conductor disposed on an outer surface of the dielectric block; and inner conductors disposed in the plurality of holes, respective gaps devoid of inner conductor being disposed near apertures of the corresponding holes;

wherein the dielectric block, the inner conductors and the outer conductor define a plurality of coupled TEM-mode resonators, thus generating a first attenuation pole at a frequency below and close to a pass band of said filter;

wherein the dielectric block and the outer conductor define a TE-mode resonator;

wherein a section devoid of outer conductor is located on at least part of an edge of one of said opening surfaces of the dielectric block, thereby setting a resonant frequency of said TE-mode resonator defined by the dielectric block and the outer conductor, such that a second attenuation pole is generated at a frequency above and close to the pass band by coaction of the TEM-mode and TE-mode resonator characteristics; and wherein said first and second attenuation poles respectively define a lower edge and a higher edge of said passband.

8. A communication apparatus comprising:

a high-frequency circuit comprising at least one of a transmitting circuit and a receiving circuit;

said at least one of a transmitting circuit and a receiving circuit comprising a respective dielectric filter, said respective dielectric filter comprising:

a substantially rectangular dielectric block having a plurality of holes therein, wherein the plurality of holes have respective openings in a pair of opposed opening surfaces of the dielectric block;

an outer conductor disposed on an outer surface of the dielectric block; and inner conductors disposed in the plurality of holes, respective gaps devoid of inner conductor being disposed near apertures of the corresponding holes and being defined by respective sections of the holes;

wherein the dielectric block, the inner conductors and the outer conductor define a plurality of coupled TEM-made resonators, thus generating a first attenuation pole at a frequency below and close to a pass band of said filter;

wherein the dielectric block and the outer conductor define a TE-mode resonator; and wherein a section devoid of outer conductor is located on at least part of an edge of one of said opening surfaces of the dielectric block, thereby setting a resonant frequency of said TE-mode resonator defined by the dielectric block and the outer conductor, such that a second attenuation pole is generated at a frequency above and close to the pass band by coaction of the TEM-mode and TE-mode resonator characteristics; and wherein the section devoid of outer conductor is disposed on a projection which projects from said edge portion of said dielectric body.

9. A communication apparatus comprising:

a high-frequency circuit comprising at least one of a transmitting circuit and a receiving circuit;

said at least one of a transmitting circuit and a receiving circuit comprising a respective dielectric filter, said respective dielectric filter comprising:

a substantially rectangular dielectric block having a plurality of holes therein, wherein the plurality of holes have respective openings in a pair of opposed opening surfaces of the dielectric block;

an outer conductor disposed on an outer surface of the dielectric block; and inner conductors disposed in the plurality of holes, respective gaps devoid of inner conductor being disposed near apertures of the corresponding holes and being defined by respective sections of the holes;

wherein the dielectric block, the inner conductors and the outer conductor define a plurality of coupled TEM-made resonators, thus generating a first attenuation pole at a frequency below and close to a pass band of said filter;

wherein the dielectric block and the outer conductor define a TE-mode resonator; and wherein a section devoid of outer conductor is located on at least part of an edge of one of said opening surfaces of the dielectric block, thereby setting a resonant frequency of said TE-mode resonator defined by the dielectric block and the outer conductor, such that a second attenuation pole is generated at a frequency above and close to the pass band by coaction of the TEM-mode and TE-mode resonator characteristics; and wherein said one of said opening surfaces is the opening surface nearest to the respective gaps devoid of inner conductor.

10. A dielectric filter according to claim 9, wherein the section devoid of outer conductor is disposed on the edge portion along at least a long side of the opening surface.

11. A dielectric filter according to claim 10, wherein the section devoid of outer conductor is disposed on a projection which projects from said edge portion of said dielectric body.

12. A dielectric filter according to claim 9, wherein the section devoid of outer conductor is disposed on a projection which projects from said edge portion of said dielectric body.

* * * * *